United States Patent [19]

Tanaka et al.

[11] Patent Number: 4,570,474

[45] Date of Patent: Feb. 18, 1986

[54] APPARATUS FOR BENDING METAL PLATE IN WIDTHWISE DIRECTION

[75] Inventors: Hiroshi Tanaka, Fujisawa; Sotozi Mitani, Sagamihara; Yasushi Sakurai, Yokohama, all of Japan

[73] Assignee: Nissan Motor Co., Ltd., Yokohama City, Japan

[21] Appl. No.: 658,219

[22] Filed: Oct. 5, 1984

[30] Foreign Application Priority Data

Oct. 12, 1983 [JP] Japan ..... 58-189174

[51] Int. Cl.[4] ..... B21D 7/04; B21D 53/88

[52] U.S. Cl. ..... 72/411; 72/315; 72/383; 72/386; 72/452; 74/110

[58] Field of Search ..... 72/411, 312–315, 72/452, 386, 385, 382, 383, 402; 74/110; 83/627; 269/234

[56] References Cited

U.S. PATENT DOCUMENTS

| | | | |
|---|---|---|---|
| 2,101,888 | 12/1937 | Ambrosius | 72/452 |
| 2,231,278 | 2/1941 | Miller | 72/402 |
| 3,266,329 | 8/1966 | Sellers et al. | 74/110 |
| 3,898,832 | 8/1975 | Eckold et al. | 72/452 |

FOREIGN PATENT DOCUMENTS

| | | | |
|---|---|---|---|
| 796868 | 4/1936 | France | 74/110 |
| 23833 | 11/1967 | Japan | 72/411 |
| 475190 | 6/1975 | U.S.S.R. | 72/315 |
| 549218 | 3/1977 | U.S.S.R. | 72/402 |

*Primary Examiner*—Daniel C. Crane

*Attorney, Agent, or Firm*—Schwartz, Jeffery, Schwaab, Mack, Blumenthal & Evans

[57] ABSTRACT

A flat metal strip is placed horizontally on a base plate which is vertically movable between a ram and a bolster of a press. A bending die for bending the metal strip by applying pressure in the widthwise direction is fixed to a slide cam slidable horizontally on the base plate. The slide cam has a slide cam face abutting on a front cam face formed in a drive cam mounted on the bolster. When the ram is moved downwards, a cover plate fixed to the ram covers the metal strip, pushes the base plate and the slide cam downwards, and compels the slide cam to slide horizontally toward the metal strip with the aid of the front and slide cam faces to bend the metal strip with the bending die. On the other hand, the drive cam has a rear cam face abutting on a press cam face formed in a press cam fixed to the ram. Therefore, with the downward movement of the ram, the press cam compels the drive cam to slide horizontally toward the metal strip and push the slide cam in the same direction with the aid of the rear and press cam faces, so that the bending die is further moved forwards.

9 Claims, 6 Drawing Figures

APPARATUS FOR BENDING METAL PLATE IN WIDTHWISE DIRECTION

BACKGROUND OF THE INVENTION

The present invention relates to apparatus for bending a flat metal plate or sheet of a hoop or strip shape by applying a pressure in the widthwise direction of the workpiece.

SUMMARY OF THE INVENTION

It is an object of the present invention to provide a new apparatus for bending a metal piece of a plate shape by applying pressure in the direction of the width of the metal piece.

It is another object of the present invention to provide such a bending apparatus so improved that the tendency toward wrinkles and other defects of a workpiece is reduced, the removal of a workpiece from the apparatus is very easy, and the stroke of a bending die is long.

According to the present invention, an apparatus for bending a metal piece of a plate shape comprises a stationary lower die unit, a substantially horizontal base plate on which a workpiece of a plate shape is placed substantially horizontally, supporting means for supporting the base plate on the lower die unit, holding means mounted on the base plate for limiting a horizontal movement of the workpiece relative to the base plate, a slide cam mounted on the base plate, a vertically movable upper die unit and a drive cam mounted on the lower die unit. The supporting means allows the base plate to move vertically. The slide cam is slidable on the base plate along a horizontal straight line in forward and reverse directions opposite to each other. The slide cam has a slide cam face, and a bending die capable of abutting on one side of the workpiece and pushing the workpiece in the forward direction. The vertically movable upper die unit has a press cam having a press cam face, and a substantially horizontal cover plate capable of confining the workpiece between the base plate and the cover plate and pushing the base plate and the slide cam downwards. The drive cam is slidable on the lower die unit along the horizontal straight line in the forward and reverse directions. The drive cam has a front cam face on which the slide cam face can slide, and a rear cam face on which the press cam face can slide. The front cam face and the slide cam face being so inclined that the slide cam is compelled to move relative to the drive cam in the forward direction when the slide cam face slides down on the front cam face. The rear cam face and the press cam face are so inclined that the drive cam is compelled to slide in the forward direction when the press die moves downwards.

DETAILED DESCRIPTION OF THE INVENTION

Figure 1:
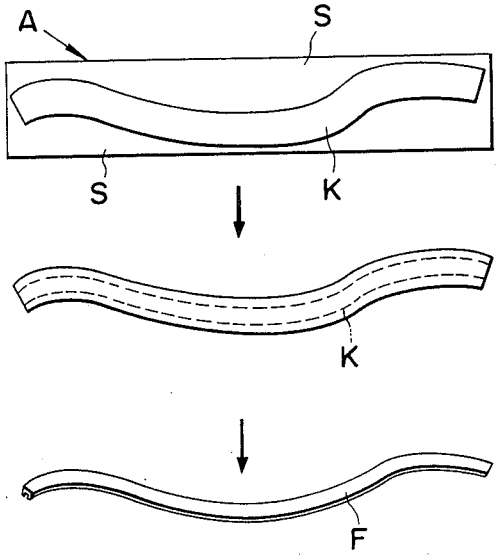
FIG.1 (PRIOR ART)
FIG. 1 is a view for illustrating a conventional method for making a curved product.

FIG. 1 shows a conventional method for fabricating a curved member of a frame of a motor vehicle body. In this method, a blank K of a predetermined curved shape is cut from a wide metal plate or sheet S with a large trim die. The shape of the blank K is such that the blank is still flat but the longitudinal line of the blank is curved in a plane parallel to the blank. The blank K is formed into a product F with a forming die. In this method, an undesirable scrap S is left over after cutting the blank K from the metal sheet S.

Figure 2:
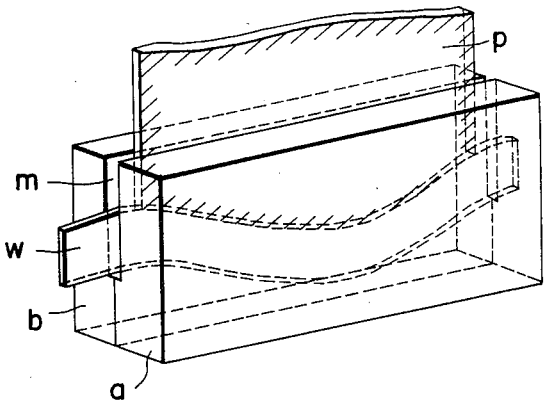
FIG.2 (PRIOR ART)
FIG. 2 is a perspective view showing another conventional method.

FIG. 2 shows another method. Holders a and b are fixed together, and there is formed, between the holders a and b, a vertical clevice m dug deep from the tops of the holders. The width of the vertical clevice m is determined by the thickness of a workpiece W of a plate shape. The workpiece W is inserted vertically into the clevice m, and then a downward pressure is applied on the workpiece in the direction of the width of the workpiece W with a bending punch P until the workpiece W is bent into a desired shape. In this method, however, wrinkles are liable to occur in the workpiece from an early stage of the bending operation because the workpiece is squeezed into the clevice. Furthermore, the workpiece is forced against the side walls of the clevice m at various places. This hampers the downward movement of the punch P, tends to produce flaws of the workpiece, and causes the workpiece to swell in thickness and get stuck so fast in the clevice that the workpiece cannot be removed easily from the clevice.

Figure 3A:
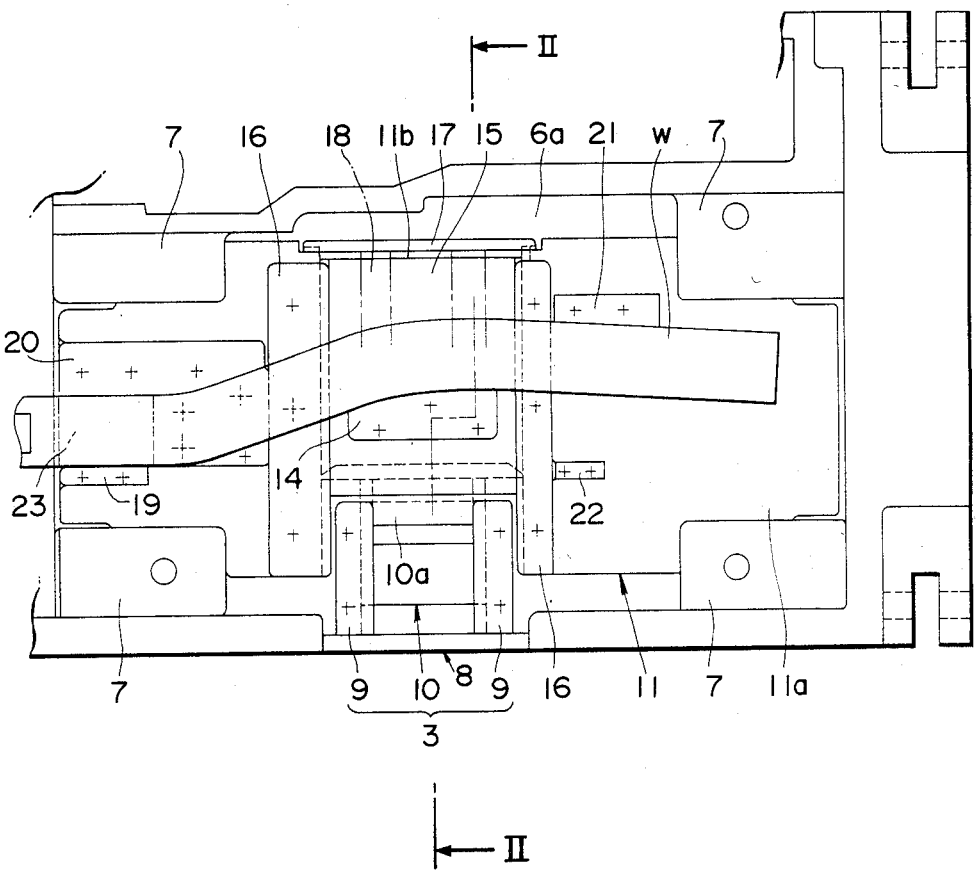
FIG. 3A is a plan view of a bending mechainsm, a cam mechanism and a lower die unit according to the present invention at a final stage of a bending operation.
Figure 3B:
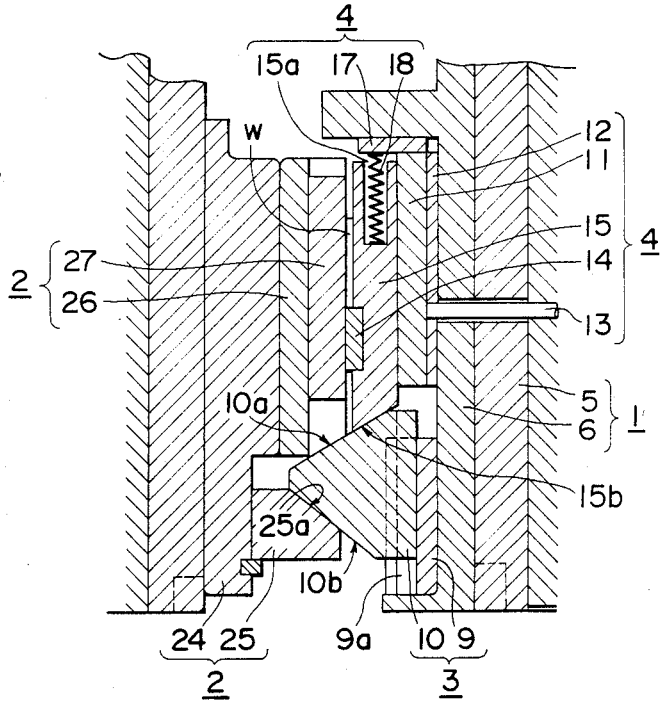
FIG. 3B is a sectional view taken across a line II—II of FIG. 3A showing the bending mechanism; the cam mechanism, the lower die unit and an upper die unit.

FIGS. 3A and 3B show a bending apparatus of one embodiment of the present invention for bending a flat metal plate or sheet of a strip or hoop shape in the widthwise direction. The apparatus comprises a lower die unit 1 mounted on a bolster B of a press, an upper die unit 2 fixed to an underside of a ram R of the press, a cam mechanism 3 slidable horizontally on the lower die unit with a downward movement of the upper die unit 2, and a bending mechanism 4 for bending a metal workpiece W of a strip or hoop shape with the movement of the cam mechanism 3.

The lower die unit 1 comprises a lower die 5 having a flat upper surface of an approximately rectangular shape, and a holder 6 fixedly mounted on the upper surface of the lower die 5. The holder 6 is formed with an approximately rectangular depression 6*a* for containing the bending mechanism 4. The holder 6 has front and rear raised brims which extend substantially in parallel to the longitudinal line of the rectangular depression 6*a* and define the width of the rectangular depression 6*a*. Four guide blocks 7 are mounted in four corners of the rectangular depression 6*a*, respectively.

The cam mechanism 3 comprises a drive cam 10 which is slidable within the rectangular depression 6*a* of the holder 6 in a forward direction toward the front raised brim of the depression 6*a* and in a reverse direction toward the rear raised brim of the depression 6*a*. Two parallel guide members 9 are fixed on the bottom of the rectangular depression 6*a* the holder 6. The parallel guide members 9 extend in a middle portion 8 of the rectangular depression 6*a* from the rear brim toward the front brim in the forward direction. The middle portion 8 of the rectangular depression 6*a* lies in the middle of the longitudinal dimension of the rectangular depression 6*a*. The guide members 9 do not reach the front brim of the rectangular depression 6*a* but terminate halfway. Each of the guide members 9 is formed with a guide groove 9*a* extending in the forward direction from the rear brim toward the front brim of the holder 6. The drive cam 10 is received in the guide grooves 9*a*, and slidable along the guide grooves 9*a* in the forward and reverse directions. The top of the drive cam 10 is formed with a front cam face 10*a* and a rear cam face 10*b* which slope in the opposite directions like a double sloping gable roof. The front cam face 10*a* slopes down in the forward direction toward the front brim of the holder 6, and the rear cam face 10*b* slopes down in the reverse direction toward the rear brim of the holder 6.

The bending mechanism 4 comprises a base plate 11, and a slide cam 15 having a bending die 14. The base plate 11 is flat, and covers all the area of the rectangular depression 6*a* excluding the portions of the cam mechanism 3 and the guide blocks 7. The base plate 11 extends substantially over the full longitudinal length of the rectangular depression 6*a* of the holder 6. A rectangular depression 11*b* is formed in a flat upper surface 11*a* of the base plate 11. The rectangular depression 11*b* lies in the middle of the longitudinal dimension of the base plate 11. The rectangular depression 11*b* extends from a rear side of the base plate 11 facing toward the rear brim of the holder 6 to a front side of the base plate 11 facing toward the front brim of the holder 6. Accordingly, the flat upper surface 11*a* of the base plate 11 is divided into left and right portions separated by the rectangular depression 11*b*. A wear plate 12 is fixed to the underside of the base plate 11. The base plate 11 is mounted on top ends of cushion pins 13 which extend vertically through the wear plate 12, the holder 16 and the lower die 5, and are supported by the bolster B. The cushion pins 13 allow the base plate 11 to move vertically. The slide cam 15 is received in the rectangular depression 11*b* of the base plate 11. The slide cam 15 is held in the rectangular depression 11*b* by two parallel keep plates 16 fixed to the base plate 11 on the opposite sides of the rectangular depression 11*b*. The keep plates 16 extend in the direction of the width of the rectangular depression 6*a* of the holder 6. The slide cam 15 is slidable along the keep plates 16 in the forward direction toward the front brim of the holder 6 and in the reverse direction toward the rear brim of the holder 6. The bending die 14 is fixed to the slide cam 15. A slide cam face 15*b* is formed in a rear end of the slide cam 15. A plurality of spring holes 15*a* are formed in a front end of the slide cam 15. The springs holes 15*a* extend in the direction of the width of the rectangular depression 6*a* of the holder 6, and open toward the front brim of the holder 6. Each of the spring holes 15*a* contains a compression coil spring 18. The springs 18 are disposed between the slide cam 15 and a spring support 17 fixed to the front side of the base plate 11. The springs 18 urges the slide cam 15 in the reverse direction toward the rear brim of the holder 6. Therefore, the slide cam face 15*b* of the slide cam 15 always abuts on the front cam face 10*a* of the drive cam 10. The upper surface of the slide cam 15, the upper surfaces of the keep plates 16 and the upper surface 11*a* of the base plate 11 including the left and right portions are all flat and lie on the same plane.

Holder plates 19, 20, 21 and 22 are fixed horizontally to the surface 11*a* of the base plate 11 at predetermined positions. The holder plates 19, 20, 21 and 22 have a thickness slightly greater than the thickness of the workpiece W. The holder plates 19 and 20 are placed on one of the left and right portions of the surface 11*a* separated by the rectangular groove 11*b*, and the holder plates 21 and 22 are placed on the other of the left and right portions of the surface 11*a*. The holder plates 19 and 20 form a holding groove 23 therebetween. The workpiece W is placed in the holding groove 23. The workpiece extends over the slide cam 15 received in the rectangular depression 11*b*, and is placed between the holder plates 21 and 22.

The upper die unit 2 comprises an upper die 24 fixed to the ram R of the press, a press cam 25 fixed to an under surface of the upper die 24, and an auxiliary plate 27 fixed to the under surface of the upper die 24 with the interposition of a press plate 26. The press cam 25 has a press cam face 25*a* capable of abutting on the rear cam face 10*b* of the drive cam 10. The auxiliary plate 27 has a flat under surface, and covers the workpiece entirely.

Figure 4:
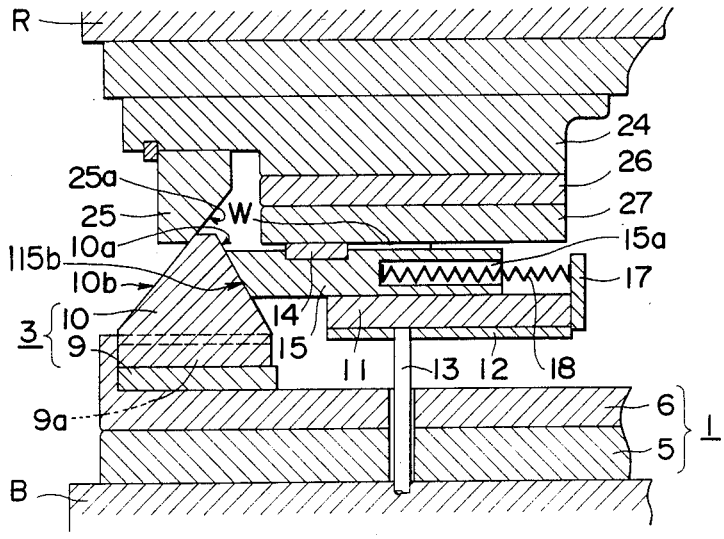
FIG. 4 is a sectional view similar to FIG. 3B, showing an early stage of the bending operation at which the upper die unit abuts on the bending mechanism and the cam mechanism.
Figure 5:
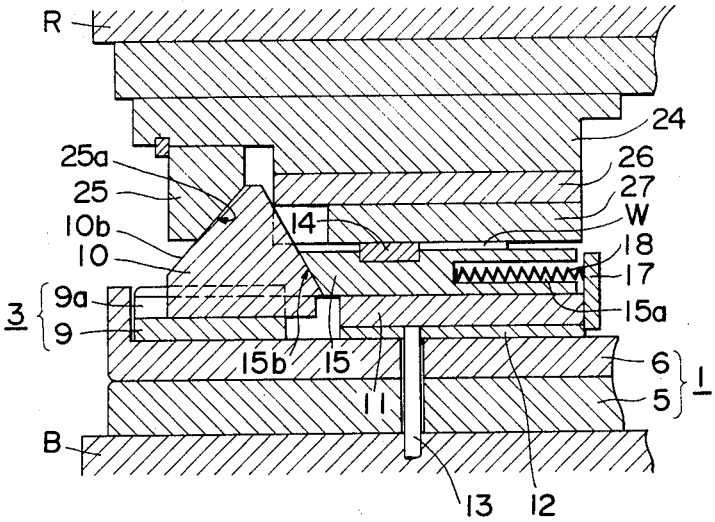
FIG. 5 is a sectional view similar to FIG. 4, showing the final stage of the bending operation.

The workpiece is bent as follows: The workpiece W which is preliminarily cut into predetermined dimensions is placed horizontally at a predetermined position on the left and right portions of the surface 11*a* of the base plate 11 and the surface of the slide cam 15. In this position, the workpiece W is fitted in the holding groove 23, and placed between the holder plates 21 and 22. Then, the ram R is moved downwards. As the ram R is moved downwards, the auxiliary plate 27 moves downwards and abuts on the holder plates 19, 20, 21 and 22. In this state, as shown in FIG. 4, the workpiece W is placed between the auxiliary plate 27, and the slide cam 15 and the surface 11*a* of the base plate 11 with a small clearance. In this state, the press cam face 25*a* of the press cam 25 abuts on the rear cam face 10*b* of the drive cam 10. As the ram R is further moved downwards, the press cam face 25*a* of the press cam 25 slides down along the rear cam face 10*b* of the drive cam 10, and pushes the drive cam 10 along the guide grooves 9*a* in the forward direction toward the front brim of the holder 6. Simultaneously, the auxiliary plate 27 pushes the slide cam 15 and the base plate 11 downwards against upward lifting forces of the cushion pins 13. Therefore, the slide cam face 15*b* slides down along the front cam face 10*a* of the drive cam 10, so that the slide cam 15 moves in the forward direction against the forces of the springs 18. The slide cam 15 is compelled to move in the forward direction by the forward movement of the drive cam 10 on one hand, and by the downward movement of the auxilary plate 27 on the other hand. Thus, the slide cam 15 compresses the springs 18 and moves in the forward direction. Finally, the ram R reaches its bottom dead point at which the wear plate 12 abuts on the holder 6, and the slide cam 15 reaches its forward limit position, as shown in FIG. 5. During this, the bending die fixed to the side cam 15 applies pressure in the widthwise direction of the workpiece on an intermediate portion of the workpiece W while the holder plates 19 and 20 hold the workpiece in the holding groove 23 on one side of the bonding die 14, and the holder plate 21 prevents the workpiece from moving in the forward direction on the opposite side of the bending die 14. In this way, the workpiece is bent into a predetermined curved shape.

When the ram R is returned to its top dead point, the bending mechanism 4 and the drive cam 10 are released from the pressures of the press cam 25 and the auxiliary plate 27, and accordingly move back to their initial positions by the aid of the forces of the springs 18 and the lifting forces of the cushion pins 13. The finished workpiece W is removed from the bending apparatus and transferred to a next process, and the bending apparatus is prepared for the next bending operation.

It is optional to further provide a means, such as springs or cylinder actuators, for lifting up the workpiece W at suitable positions in the slide cam 15 and the base plate 11 in order to further facilitate the removal of the finished workpiece from the bending apparatus.

According to the present invention, it is possible to install and remove a long workpiece by moving the workpiece horizontally in the direction of the width of the workpiece. Furthermore, it is possible to prevent flaws and other irregularities from occurring in the workpiece during bending. Accordingly, the quality of products and the productivity can be improved. Furthermore, the present invention makes it easy to automatize a series of production processes such as cutting, bending, trimming and piercing. The bending apparatus of the present invention can provide a large displacement of the bending die by adding a forward displacement of the drive cam and a forward displacement of the slide cam relative to the drive cam. Accordingly, it is possible to bend the workpiece largely.

What is claimed is:

1. An apparatus for bending a metal piece of a plate shape, comprising:

a stationary lower die unit, a substantially horizontal base plate on which a workpiece of a plate shape is placed substantially horizontally, supporting means for supporting said base plate on said lower die unit in such a manner that said base plate is movable vertically, holding means mounted on said base plate for limiting horizontal movement of the workpiece relative to said base plate, a slide cam mounted on said base plate and slidable along a horizontal straight line in forward and reverse directions opposite to each other, said slide cam having a slide cam face, and a bending die capable of abutting on one side of the workpiece and pushing the workpiece in the forward direction, said bending die being movable relative to said base plate and said holding means, a vertically movable upper die unit having a press cam having a press cam face, and a substantially horizontal cover plate capable of confining the workpiece between said base plate and said cover plate and pushing said base plate and said slide cam downwards, and a drive cam mounted on said lower die unit and slidable along the horizontal straight line in the forward and reverse directions, said drive cam having a front cam face on which said slide cam face can slide, and a rear cam face on which said press cam face can slide, said front cam face and said slide cam face being so inclined that said slide cam is compelled to move relative to said drive cam in the forward direction when said slide cam face slides down on said front cam face, said rear cam face and said press cam face being so inclined that said drive cam is compelled to slide in the forward direction when said press die moves downwards.

2. An apparatus according to claim 1, wherein said front cam face slopes down in the forward direction, and said rear cam face slopes down in the reverse direction.

3. An apparatus according to claim 2, further comprising biasing means disposed between said base plate and said slide cam for urging said slide cam in the reverse direction.

4. An apparatus according to claim 3, wherein said slide, press, front and rear cam faces are all flat, said press cam face facing a direction intermediate between the downward direction and the forward direction, said rear cam face being parallel to said press cam face, said slide cam face facing a direction intermediate between the downward direction and the reverse direction, said front cam face being parallel to said slide cam face.

5. An apparatus according to claim 4, wherein said slide cam is received in a depression formed in said base plate, said slide cam extends under the workpiece placed on said base plate.

6. An apparatus according to claim 5, wherein said base plate has left and right portions between which said depression is formed, and upwardly facing surfaces of said left and right portions of said base and said slide cam are flat and placed in the same plane.

7. An apparatus according to claim 6, wherein said holding means comprises a left holder plate fixed to the upwardly facing surface of said left portion of said base plate and a right holder plate fixed to the upwardly facing surface of said right portion of said base plate, said left and right holder plates limiting a horizontal movement of the workpiece relative to said base plate in the forward direction by abutting the workpiece from the forward direction.

8. An apparatus according to claim 7, wherein said supporting means urging said base plate upwards.

9. An apparatus according to claim 8, wherein said biasing means comprises a plurality of compression coil springs each of which is received in a hole formed in said slide cam.

* * * * *